US005550313A

United States Patent [19]

Hayden

[11] Patent Number: 5,550,313

[45] Date of Patent: Aug. 27, 1996

[54] TREATMENT OF NORM-CONTAINING MATERIALS FOR MINIMIZATION AND DISPOSAL

[75] Inventor: Christopher G. Hayden, Friendswood, Tex.

[73] Assignee: Institute of Gas Technology, Des Plaines, Ill.

[21] Appl. No.: 326,507

[22] Filed: Oct. 20, 1994

[51] Int. Cl.[6] ..... A62D 3/00; G21F 9/34

[52] U.S. Cl. ..... 588/256; 423/2; 588/18; 588/252

[58] Field of Search ..... 588/18, 20, 252, 588/256; 423/2

[56] References Cited

U.S. PATENT DOCUMENTS

| | | | |
|---|---|---|---|
| 3,896,045 | 7/1975 | Peeters et al. . | |
| 3,949,047 | 4/1976 | Cherdon et al. . | |
| 4,146,568 | 3/1979 | Lange, Jr. | 423/170 |
| 4,265,861 | 5/1981 | Cleary et al. | 423/2 X |
| 4,328,193 | 5/1982 | Larson . | |
| 4,423,007 | 12/1983 | Weir et al. . | |
| 4,451,438 | 5/1984 | Floeter et al. | 423/2 X |
| 4,917,825 | 4/1990 | McDowell et al. . | |
| 4,973,201 | 11/1990 | Paul et al. | 405/264 |
| 5,188,809 | 2/1993 | Crocker et al. | 528/20 X |
| 5,207,532 | 5/1993 | Mason et al. | 405/128 |
| 5,288,411 | 2/1994 | Gallup et al. | 210/700 |
| 5,370,827 | 12/1994 | Grant et al. | 588/18 |

*Primary Examiner*—George A. Suchfield
*Attorney, Agent, or Firm*—Speckman, Pauley & Fejer

[57] ABSTRACT

A process for extraction of sodium from NORM-containing materials in which the NORM-containing materials are treated with a first acid, forming a spent acid solution comprising dissolved carbonates, salts, iron and/or sulfates, and a NORM-containing solid material. The NORM-containing material is separated from the spent acid solution and treated with concentrated sulfuric acid, dissolving the NORM and forming a NORM-containing acid. Any undissolved solids are removed from the NORM-containing acid which is then saturated with barite. To precipitate the NORM in the NORM-containing acid, water is added, preferably in stages to the barite-saturated NORM-containing acid. Essentially, all NORM-free components in scales, sludges, and soils are separated from the NORM and its carrier. The NORM-containing product, preferably barite, is a fine powder suitable for use in several subsequent disposal technologies.

14 Claims, No Drawings

TREATMENT OF NORM-CONTAINING MATERIALS FOR MINIMIZATION AND DISPOSAL

BACKGROUND OF THE INVENTION

1. Field of the Invention

This invention relates to a process for extraction of radium from naturally occurring radioactive material (NORM)-containing materials such as scales, sludges, soils and sediments in which the NORM (radium), and any carrier, such as barite, which may be present, is first dissolved, then separated from NORM-free solids and then precipitated along with a carrier (barite). The process provides the NORM-containing barite as individual crystals of a size and shape that allows injection as a slurry through sandstone. This process is particularly useful for the treatment of NORM-containing scales, sludges, soils and sediments present in oil fields, particularly from drums, vessels and pipe, including pipe in wells or buried pipe, thereby providing an alternative to disassembly and hydro-blasting of these systems.

2. Description of Prior Art

The U.S. oil and gas industries generate up to 700,000 tons per year of materials that contain naturally occurring radioactive materials (NORM). Storage and disposal of large quantities of low level NORM-contaminated scale in the oil and gas industry is a difficult and expensive proposition. What is needed is a method to reduce the volume of the material generated by these industries, thereby making handling and disposal of these materials more efficient.

Radium-containing material, which is the NORM problem associated with oil and gas production, is found in three general forms. Material containing modest levels of radioactivity, ranging from very low to over 20,000 picoCuries per gram are found in pipe scale and in production equipment. This scale is usually, but not always, barite and other sulfates, and sand. Lower levels of radioactivity, from very low to about 2,000 picoCuries per gram are found in sludge in tank bottoms and pits. This material often contains substantial quantities of oil, water, iron corrosion products, sulfate and carbonate scales, and sediments. Finally, very low levels of radioactivity, usually less than 200 picoCuries per gram are found in contaminated soils.

The most common disposal method for NORM-containing waste is to encapsulate it in pipes and place these pipes between cement plugs in abandoned wells. In some cases, the amount of NORM-containing material is too great for this to be economical or practical. Concern also exists about casing collapse and long-term containment.

NORM-containing waste has also been mechanically ground and injected at pressures above the fracture pressure into some off-shore subsurface formations. Mechanical grinders used for this purpose grind the material to sizes as low as 10 microns in diameter. However, this is still large relative to the pore throat diameter in typical sandstone formations.

NORM-containing waste is also commonly packed in drums for on-site and off-site storage until a suitable disposal opportunity is found. Many thousands of such drums have accumulated at such storage facilities.

Conventional means for removing NORM from vessels and pipe systems comprising heavily encrusted iron is by disassembly of the vessels and/or pipes, often by cutting, and hydro-blasting the encrusted material from the vessel and pipe surfaces, followed by scraping and hydro-blasting of the vessels and pipes. Where disassembly and hydro-blasting of the encrusted material is not feasible, such as for pipes in off-shore oil wells, expensive chelating agents are used. These same chelating agents have been proposed for scale, sludge, and soil treatment. For example, U.S. Pat. No. 4,973,201 teaches the treatment of NORM in surface layers of the earth with an aqueous chemical composition including a polyaminopolycarboxylic acid (chelating agent) such as ETDA or DTPA in combination with a synergist, preferably oxalate or monocarboxylic acid anion such as salicylate which increases solubility of sulfates in an aqueous solution. In contrast to the process of the invention disclosed herein, the process taught by the '201 patent is slower and more than an order of magnitude more expensive. Similarly, U.S. Pat. No. 4,917,825 describes the actions of an organic chelating agent that is more selective toward radium than ETDA. In particular, the '825 patent teaches a solvent composition of an organophilic carboxylic acid and an organophilic macrocycle dissolved in a hydrocarbon solvent for extraction of radium. However, due to the use of expensive chelating agents, this process is expensive and implementation of this process requires extensive pre-treatment to oil field sludges and a substantial length of time for extraction of the radium.

U.S. Pat. No. 5,207,532 teaches a process for chemically treating, physically shearing and separating NORM from deposits by slurrying the NORM-containing material and treating the resulting slurry with an oxidizing agent, in particular chlorine dioxide, chlorine, hydrogen peroxide, sodium hypochlorite, sodium chlorite, and sodium perporate. In accordance with one embodiment, the slurry of deposits is treated to render the large non-radioactive particles therein free flowing with respect to the smaller radioactive particles, which large non-radioactive particles are removed therefrom, for example, by screening, thereby leaving behind a reduced mass of NORM for disposal.

U.S. Pat. No. 4,146,568 teaches a process for reducing the radioactive contamination in waste product gypsum in which the gypsum is reacted with a dilute sulfuric acid containing barium sulfate to form an acid slurry at an elevated temperature. The slurry is cooled and the acid component is separated from the solid. The resulting solid is separated into a fine and a coarse fraction, the fine fragment being predominately barium sulfate and radioactive contamination. In accordance with the teachings of this patent, the barium sulfate is employed as a radium sorbent. Similarly, U.S. Pat. No. 3,896,045 teaches a process for extracting radium from liquids using a barium sulfate/barium salt sorbent. In particular, the liquid is contacted with sorbent in a sulfate-containing medium of a barium salt or a barium salt mixed with the metal ferrocyanide to which sulfuric acid is added to promote sorption of the radioactive ions.

U.S. Pat. No. 4,328,193 teaches a process for separating radium from monocalcium phosphate solutions by centrifuging the solutions to separate a portion of radium-containing contaminants from the solution and treating the remaining solution with sulfuric acid to produce a phosphoric acid solution and calcium sulfate product containing radium.

U.S. Pat. No. 3,949,047 teaches separation of radium from phosphate ores by reaction of a monocalcium phosphate-containing solution with at least one soluble barium compound in the presence of sulfate ions, resulting in co-precipitation of contaminant radium ions which would otherwise be precipitated with the calcium sulfate.

Finally, U.S. Pat. No. 4,423,007 teaches a process for removal of radium from a radium-containing aqueous solution which contains dissolved magnesium by adding soluble barium salt to precipitate radium sulfate. An insoluble magnesium compound is then precipitated which collects the sulfate. Thereafter, the precipitates are separated from the solution.

Of the aforementioned prior art, only the teachings of U.S. Pat. No. 4,973,201 and U.S. Pat. No. 5,207,532 are applicable to insoluble barite scales found in oil field sludges and soils. However, each of these patents teach a process which is less efficient, and in one case more expensive, than the process of this invention as described hereinbelow.

SUMMARY OF THE INVENTION

It is an object of this invention to provide a process for extraction of radium from naturally occurring radioactive material (NORM)-containing scales, sludges, iron, soils, and sediments typically found in connection with oil and gas production.

It is an object of this invention to provide a process for extraction of radium in a barite carrier from naturally occurring radioactive material (NORM)-containing scales, sludges, iron, soils, and sediments typically found in connection with oil and gas production.

It is another object of this invention to provide a process for in situ treatment of oil and gas field vessels and pipes to remove NORM therefrom without disassembling of such vessels and pipes.

It is another object of this invention to provide a process for extraction of radium from a heterogeneous mixture of NORM-free and NORM-containing materials, such as barite or other scales, leaving the NORM-free material as non-hazardous waste.

It is yet another object of this invention to provide a process for concentration of radium within NORM-containing material, such as barite, leaving behind a balance of material (barite) which is non-hazardous and a smaller quantity of material (barite) with elevated levels of NORM.

It is yet another object of this invention to provide a process for diluting NORM in a barite carrier, proving an homogeneous product that has a lower radium concentration than the feed material.

It is yet another object of this invention to provide a process for extraction of radium from NORM-containing material whereby the radium-containing end product has a particle size suitable for slurrying and subsurface injection.

These and other objects of this invention are achieved by a process for extraction of radium from NORM-containing materials comprising the steps of treating NORM-containing material with a first solvent, forming a spent first solvent solution comprising dissolved carbonates, salts, iron, and/or sulfates, and a NORM-containing solid material. The NORM-containing solid material is separated from the spent first solvent solution and treated with a second solvent which dissolves at least the NORM in the NORM-containing solid material and forms a NORM-containing solvent. In accordance with one embodiment of the process of this invention, the material containing said NORM is also dissolved by the second solvent. Any remaining solids in said NORM-containing solvent, such as sand, are removed. The NORM-containing solvent is saturated with barite, forming a barite-saturated NORM-containing solvent. By addition of water to the barite-saturated NORM-containing solvent, at least a portion of the NORM in the NORM-containing solvent is co-precipitated.

In accordance with one embodiment of the process of this invention, the first solvent for treating the NORM-containing materials is an inexpensive acid, such as hydrochloric acid or nitric acid. The second solvent by which the NORM in the NORM-containing solid material is dissolved to form a NORM-containing solvent is preferably concentrated or fuming sulfuric acid. The end products of this process are spent acid, NORM-free sand, sediments, and scales, dilute sulfuric acid, and barite crystals containing the NORM. The size of the NORM-containing barite particles are typically 5 microns or less in diameter. Uniform submicron size particles suitable for mixing with cement, forming stable slurries, or direct injection into subsurface formations, can also be produced. Methods known to those skilled in the art of crystallization may be employed to control particle size.

The process of this invention separates all nonbarite components of the original NORM-containing material from the barite and the NORM. The activity of the final barite product can be changed to a level selected by the operator. Concentrating by means of fractional crystallization reduces the volume of NORM, while diluting allows some disposal options that are not available for material that has a very high activity. The NORM remains in barite particles. This inert crystal structure minimizes many of the hazards, such as radon emanation and accidental releases that may occur when handling NORM. Because there is no calcium in the barite/NORM product, the material can be added to cement without altering the properties of the cement.

DESCRIPTION OF PREFERRED EMBODIMENTS

The process of this invention is a crystallization based method for extraction of radium from NORM-containing material and concentration of it into a smaller mass of barium sulfate. The process removes calcium, strontium, iron, carbonates, clays, sand, and a user selectable fraction of barite scale. The end product is a radium bearing fraction that has a particle size range between submicron to several microns in diameter. This material is well-suited for handling as a slurry and for subsurface injection.

The process is applicable to barium, strontium, calcium, and mixed sulfate and carbonate scales, to sludges and to a matrix of sediments, scales and soils. The sludges must be pretreated using readily available physical processes to remove oil and water. Thereafter, the solids are treated with an inexpensive acid, such as hydrochloric acid or nitric acid, to remove carbonates, some clays, iron, and salts. In accordance with one embodiment of this invention, surfactants are also employed in the treatment of the solids to remove residual hydrocarbons. The carbonate, clays, iron, and salts, as well as some sulfates, dissolve in the acid, leaving behind solids which can be separated from the spent acid for additional treatment.

In accordance with one embodiment of this invention, if NORM is entrained in this first acid following this initial treatment with the first acid, a small quantity of barium sulfate (barite) saturated sulfuric acid can be added to this first acid resulting in crystallization of the barite and simultaneous stripping of radium from the spent acid. In accordance with one preferred embodiment of this invention, between about 0.1% and 5% by weight of the barite/sulfuric acid solution is employed to generate a sufficient volume of barite for stripping of the radium from the spent acid solution.

The solids separated from the spent acid solution includes all of the barite and NORM originally contained in the NORM-containing material. In the second step of this process, these solids are treated with a second solvent, preferably concentrated or fuming sulfuric acid, which dissolves the barite and the NORM. For greatest efficiency, it is preferred that only enough concentrated sulfuric acid to produce an acid solution saturated with barium sulfate when all of the soluble solid has been dissolved be used. Any remaining undissolved materials, such as sand, are physically removed. This solid material is essentially free of NORM.

The amount of water present in the concentrated sulfuric acid solution affects the quantity of barite dissolved in this step. The range of water in sulfuric acid used for dissolution purposes must be in the range of 0% to about 20% by weight of the concentrated sulfuric acid solution. Preferably, the water content of the sulfuric acid is between about 0% to about 5% by weight because the solubility of barite decreases as water concentration increases.

The process of this invention can be carried out over a broad range of temperature ranges from just above the freezing point of the acid solution used to over 212° F.

The NORM-containing solution remaining after removal of the undissolved solids is saturated with barite. To this barite-saturated NORM-containing solution, water is added, either in its liquid form or as ice, resulting in precipitation of at least some of the barite and NORM. In accordance with a preferred embodiment of this invention, precipitation of the NORM is carried out in steps by the addition of water to the barite-saturated NORM-containing solution in stages. Between each addition of water, the solids are allowed to remain in contact with the solution for several hours before physically removing them. In this manner, each subsequent precipitate in the fractional crystallization process contains more radium than the previous precipitate. The process is, thus, repeated until essentially all NORM has been precipitated out of the solution. Thereafter, the precipitated solids are separated into enriched and depleted fractions. The sulfuric acid can be regenerated (de-watered) and reused until salts, including calcium and strontium, build-up adversely affects performance.

EXAMPLE I

A sample of scale containing NORM was obtained and treated with hydrochloric acid to remove iron, carbonates, salts, and other soluble minerals. The partially spent acid contained 6400 pCi/L radium-226 prior to treatment with barite dissolved in sulfuric acid. After mixing the acids and separating out the precipitates, the liter acid sample had no measurable activity when measured with a scintillation meter. The solids were then separated from the acid. A total of 5.7 grams of the remaining solid was dissolved in 60.8 grams of 100% sulfuric acid and 2.4 grams of water. The precipitation, digestion, and separation were performed at 80° C. 1.5 grams of water were added to the acid solution resulting in formation of precipitate. The precipitate was separated from the acid three hours later and designated "Sample A". The procedure was then repeated two more times, creating "Sample B" and "Sample C". Thereafter excess water was added to the acid solution. The dilute acid was separated from the precipitate that formed, designated "Sample D", after four hours. The four solid samples thus obtained were water-washed and dried.

The samples were analyzed by X-ray diffraction and were determined to be pure barium sulfate. The radium-226 content was measured by dissolving the samples and then measuring radon emanation. The radium-228 was calculated from radium-226 to radium-228 ratios determined by gamma spectroscopy. The results of this analysis are shown in Table 1.

TABLE 1

| Sample | Mass, grams | Activity, μR/h/g | Radium-226, pCi/g | Radium-228, pCi/g |
|---|---|---|---|---|
| A | 1.72 | 3.5 | 5869 ± 353 | 2348 ± 141 |
| B | 2.36 | 3.5 | 5966 ± 299 | 2249 ± 112 |
| C | 1.15 | 7.3 | 13933 ± 129 | 5016 ± 52 |
| D | 0.22 | 17 | 20130 ± 1150 | 7327 ± 580 |

It will be noted from the data in Table 1 that the concentration of radium in the last fraction to precipitate, that is, "Sample D", was 3.3 times higher than that found in the first solids to precipitate, "Sample A".

EXAMPLE II

A second acid sample containing dissolved barite was precipitated in a manner to minimize particle size, that is, with a large excess of water and constant stirring. The sample was then run through a Coulter Counter to measure the particle size distribution. The sample was allowed to sit three hours and the analysis was repeated. The data, shown hereinbelow in Table 2, show that sub-micron particles can be formed, but they will grow over time in the absence of inhibition.

TABLE 2

| Particle Diameter (μm) | Fresh Precipitate (wt. %) | Aged Precipitate (wt. %) |
|---|---|---|
| >2.00 | 0.0 | 0.0 |
| >1.59 | 0.0 | 0.8 |
| >1.26 | 0.6 | 10.5 |
| >1.00 | 7.8 | 36.5 |
| >0.79 | 30.0 | 65.6 |
| >0.63 | 66.8 | 88.8 |
| >0.50 | 100 | 100 |
| >0.30 | 100 | 100 |

It can be seen from the data in Table 2 that the process of this invention produces very small, compact, crystals within a narrow size range. Sizes small relative to the pore structure in sandstone are easily achieved. As a result, the particles are well-suited for handling in a slurry and for subsurface injection.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A process for extraction of radium from naturally occurring radioactive material (NORM)-containing materials comprising the steps of:

treating said NORM-containing materials with a first acid, forming a spent acid solution comprising at least: one of dissolved carbonates, salts, iron, and sulfates and a NORM-containing solid material;

separating said NORM-containing solid material from said spent acid solution and treating said NORM-containing solid material with a second acid selected from the group consisting of concentrated sulfuric acid, fuming sulfuric acid and mixtures thereof, dissolving NORM in said NORM-containing solid material and forming a NORM-containing acid;

removing any remaining solids from said NORM-containing acid and saturating said NORM-containing acid with barite;

adding water to said barite-saturated NORM-containing acid, precipitating at least a portion of said NORM in said NORM-containing acid; and removing said NORM from said NORM-containing acid.

2. A process in accordance with claim 1, wherein said NORM is co-precipitated with at least a portion of said barite in said barite-saturated NORM-containing acid.

3. A process in accordance with claim 1 further comprising treating said spent acid solution comprising residual radium with barite-saturated sulfuric acid, co-crystallizing barite and said residual radium, thereby stripping said residual radium present in said spent acid solution from said spent acid solution.

4. A process in accordance with claim 1, wherein said addition of water to said barite-saturated NORM-containing acid is carried out in discrete stages.

5. A process in accordance with claim 1, wherein said concentrated sulfuric acid comprises between about 0.0% and about 20% by weight water.

6. A process in accordance with claim 1, wherein said addition of water to said barite-saturated NORM-containing acid is carried out in one stage.

7. A process in accordance with claim 1, wherein the temperature of said acid ranges from proximate the freezing point of said first acid to about 220° F.

8. A process in accordance with claim 1, wherein said first acid is one of hydrochloric acid and nitric acid.

9. A process in accordance with claim 1, wherein said NORM-containing material is selected from the group consisting of scales, sludges, soils, sediments and mixtures thereof.

10. A process in accordance with claim 1, wherein said NORM-containing material is de-watered and de-oiled prior to treatment with said first acid.

11. A process for extraction of radium from naturally occurring radioactive material (NORM)-containing materials comprising the steps of:

treating said NORM-containing materials with a first solvent, forming a spent first solvent solution comprising at least one of dissolved carbonates, salts, iron, and sulfates and a NORM-containing solid material;

separating said NORM-containing solid material from said spent first solvent solution and treating said NORM-containing solid material with a second solvent, dissolving NORM in said NORM-containing solid material and forming a NORM-containing solvent;

removing any remaining solids from said NORM-containing solvent and saturating said NORM-containing solvent with NORM-free barite; and adding water to said barite-saturated NORM-containing solvent, co-precipitating at least a portion of said NORM from said NORM-containing solvent with at least a portion of said barite.

12. A process in accordance with claim 11, wherein said first solvent is an acid.

13. A process in accordance with claim 11, wherein said second solvent is concentrated sulfuric acid.

14. A process in accordance with claim 11, wherein said second solvent is fuming sulfuric acid.

* * * * *